United States Patent [19]

Whitehouse

[11] Patent Number: 4,671,737

[45] Date of Patent: Jun. 9, 1987

[54] BLADE PITCH CHANGING MECHANISM

[75] Inventor: John W. Whitehouse, Rockford, Ill.

[73] Assignee: Sundstrand Corporation, Rockford, Ill.

[21] Appl. No.: 686,303

[22] Filed: Dec. 26, 1984

[51] Int. Cl.[4] ..... F01D 7/02

[52] U.S. Cl. ..... 416/165; 416/47; 416/160; 416/162

[58] Field of Search ..... 416/165, 46, 47, 49, 416/160, 162

[56] References Cited

U.S. PATENT DOCUMENTS

| | | | |
|---|---|---|---|
| 2,255,920 | 9/1941 | Englesson | 416/162 X |
| 2,309,899 | 2/1943 | Hepperle | 416/162 |
| 2,360,982 | 10/1944 | Sahle | 416/160 X |
| 2,378,580 | 6/1945 | Prause et al. | 416/47 |
| 2,378,938 | 6/1945 | McCoy . | |
| 2,484,603 | 10/1949 | Audemar et al. | 416/47 |
| 2,604,615 | 7/1952 | Peterson et al. . | |
| 2,613,751 | 10/1952 | Donovan et al. . | |
| 2,666,490 | 1/1954 | Richmond . | |
| 2,669,312 | 2/1954 | Dinsmore et al. . | |
| 2,670,805 | 3/1954 | Nichols | 416/160 X |
| 2,689,010 | 9/1954 | Page . | |
| 2,738,183 | 3/1956 | Quinn et al. . | |
| 2,761,520 | 9/1956 | Hendrix et al. . | |
| 2,849,072 | 8/1958 | Brahm . | |
| 2,887,164 | 5/1959 | Hendrix et al. . | |
| 2,913,056 | 11/1959 | Farkas . | |
| 2,937,888 | 5/1960 | Nichols . | |
| 2,949,159 | 8/1960 | Kessler et al. . | |
| 3,004,608 | 10/1961 | Pond . | |
| 3,212,586 | 10/1965 | Barnes et al. | 416/46 |
| 3,640,644 | 2/1972 | Liaaen | 416/162 X |
| 3,936,226 | 2/1976 | Harner et al. | 416/28 |
| 3,973,873 | 8/1976 | Shank | 416/43 |
| 4,037,986 | 7/1977 | Chilman | 416/46 |
| 4,097,189 | 6/1978 | Harlamert | 416/46 |
| 4,484,492 | 11/1984 | Cadic | 416/162 X |
| 4,527,072 | 7/1985 | Degeer | 416/165 X |

FOREIGN PATENT DOCUMENTS

| | | | |
|---|---|---|---|
| 1134096 | 4/1957 | France | 416/165 |
| 1247938 | 10/1960 | France | 416/163 |
| 443022 | 12/1948 | Italy | 416/163 |
| 860205 | 2/1961 | United Kingdom | 416/165 |

*Primary Examiner*—Everette A. Powell, Jr.

*Attorney, Agent, or Firm*—Wood, Dalton, Phillips, Mason & Rowe

[57] ABSTRACT

Overspeed conditions in a ram air turbine are eliminated through a novel blade pitching mechanism. The mechanism includes a rotatable shaft with a hub mounted thereon for rotation therewith. The hub rotatably mounts at least one blade and a hollow blade pitch control shaft extends generally concentrically about the rotatable shaft and is mounted for reciprocating movement in a path toward and away from the hub. A reciprocating to rotary motion converting mechanism interconnects the control shaft and the blade so that the pitch of the blade can be controlled by controlling the position of the control shaft in the path. A first motor is provided for incrementally moving the control shaft within the path and a second motor is provided for rapidly moving the control shaft within the path to a position therein corresponding to a feathered position of the blades.

11 Claims, 5 Drawing Figures

BLADE PITCH CHANGING MECHANISM

FIELD OF THE INVENTION

This invention relates to a blade pitch changing mechanism which may be employed in any of a variety of environments wherein it is desirable to change the pitch of a blade being rotated, during such rotation, at two different rates. Though not limited thereto, the invention is particularly suited for use as an emergency feathering device for turbine blades.

BACKGROUND OF THE INVENTION

Prior art of possible relevance includes U.S. Pat. Nos. 2,378,580 issued June 19, 1945 to Prause et al and 2,378,938 issued June 26, 1945 to McCoy.

As mentioned previously, the invention herein, while it may be utilized with efficacy in a variety of environments is, in its best mode, comtemplated to be employed in a system to provide emergency feathering of a ram air turbine. Such turbines are typically utilized to drive a load in response to rotary motion generated by the passage of a fluid, usually air, across turbine blades. In the usual case, means are provided for adjusting the pitch of the turbine blades to achieve a desired rotational output, typically constant speed, for varying loads and conditions.

In the usual case, a small motor, frequently a stepping motor, is utilized to make fine adjustment of the pitch of the blades in response to suitable control signals. For normal operation, such a system works well. However, in some instances, pitch adjustment through the use of such a small motor cannot be achieved with sufficient rapidity for the particular situation involved.

For example, if one considers the situation where the load on the turbine shaft is suddenly removed or drastically reduced, the turbine, now being unloaded, may be driven into a damaging overspeed condition before the pitch of the blades can be adjusted sufficiently to prevent such from happening by the small motor. This occurrence is not unlikely where the turbine blades are at a fine pitch when the load is removed and must be driven to a course pitch or feathered position to prevent overspeed from occurring.

The present invention is directed to overcoming the foregoing problem.

SUMMARY OF THE INVENTION

It is the principal object of the invention to provide a new and improved blade pitch changing mechanism. More specifically, it is an object of the invention to provide such a mechanism wherein fine pitch adjustment can be achieved through the use of a small motor and wherein, rapid, coarse or gross blade adjustment is achieved through the use of a second motor. Specifically, the invention is intended to provide a blade pitch changing mechanism including means whereby, in case of an emergency, the blades may be rapidly feathered.

An exemplary embodiment of the invention achieves the foregoing objects in a construction including a rotatable shaft having a hub mounted thereon. At least one blade is mounted on the hub for rotation about an axis intersecting the shaft and a blade pitch control element extends generally parallel to the shaft and away from the hub. The control element is mounted for reciprocating movement in a path toward and away from the hub and a reciprocating to rotary motion converting mechanism interconnects the control element and the blade so that the pitch of the blade may be controlled by controlling the position of the control element in the path. A first motor is provided for incrementally or finely moving the control element within the path and a second motor is provided for grossly moving the control element within the path.

When used as an emergency feathering device, the second motor can be made to rapidly move the control element within the path to a position wherein the blade or blades are feathered.

In a highly preferred embodiment, the control element is a hollow shaft concentric about the rotatable shaft. The hollow shaft is threaded at a location remote from the hub. The construction further includes a rotatable nut threaded on the hollow shaft. The first motor rotates the nut while the nut is in a fixed axial position and the second motor is operative to move the nut axially.

The invention contemplates that the nut include gear teeth and that there be a gear meshed with the gear teeth. The first motor drives the gear. The second motor is operable to sufficiently move the nut axially as to disengage the gear teeth from the gear in an emergency situation.

The invention may include an escapement mechanism normally locating the nut at a predetermined axial position. The second motor normally acts against the nut oppositely of the escapement mechanism. Means are provided for operating the escapement mechanism to release the nut for axial movement by the second motor. In a highly preferred embodiment, the second motor is a spring. The escapement mechanism may include a cam follower in engagement with the nut oppositely of the spring. The cam follower has a plurality of axially directed fingers. A cam is associated with the cam follower and has a pluality of notches or recesses for receiving an associated one of the fingers. Means are provided for rotating the cam to align the fingers with the recesses thereby allowing the spring to move the nut axially.

In a preferred embodiment, the cam and cam follower are concentric with the rotary shaft.

Other objects and advantages will become apparent from the following specification taken in connection with the accompanying drawings.

DESCRIPTION OF THE PREFERRED EMBODIMENT

Figure 1A:
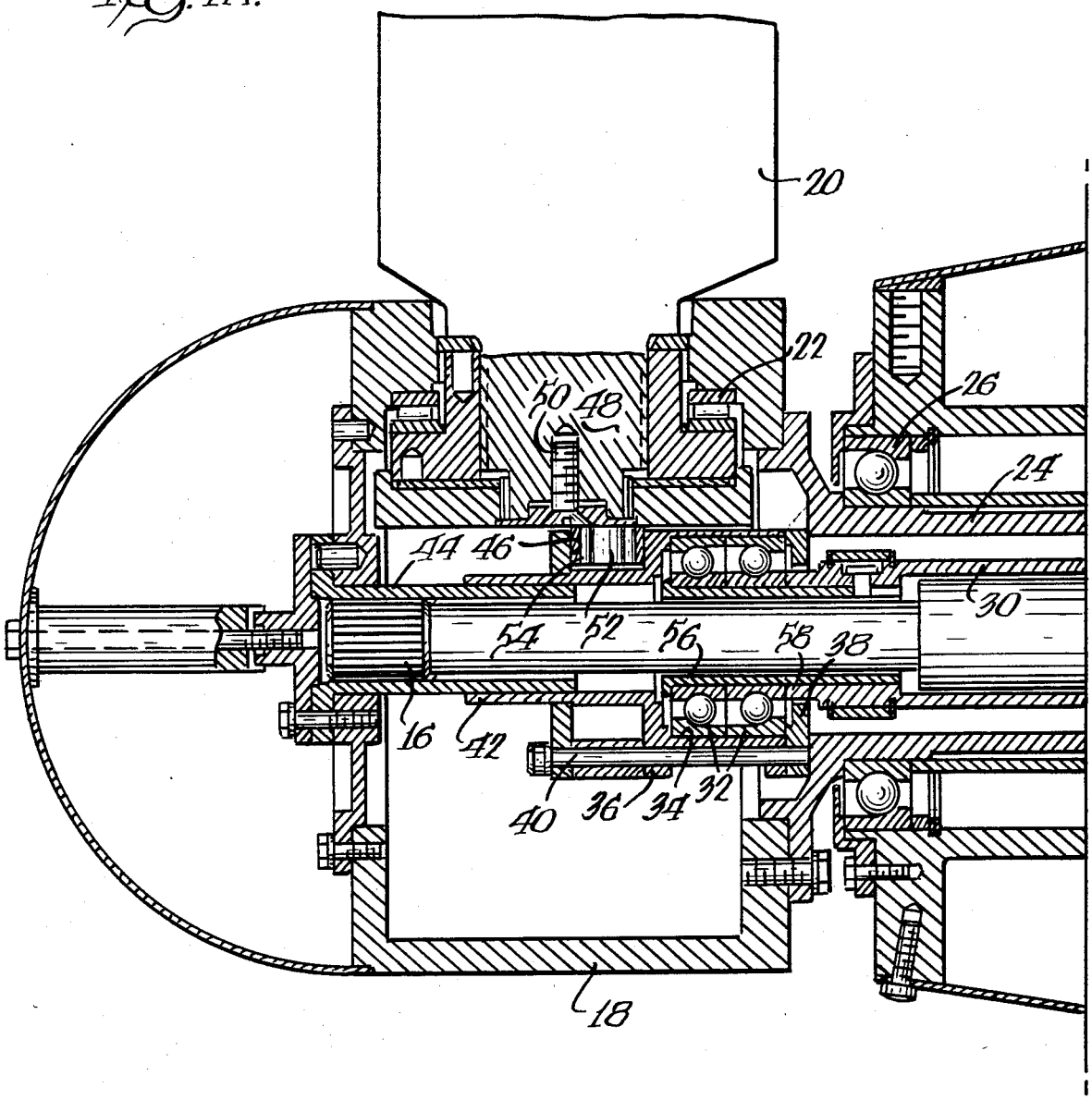
FIG. 1 is a sectional view of a blade pitch changing mechanism made according to the invention and is composed of FIGS. 1A and 1B, the latter to be placed to the right of the former.
Figure 1B:
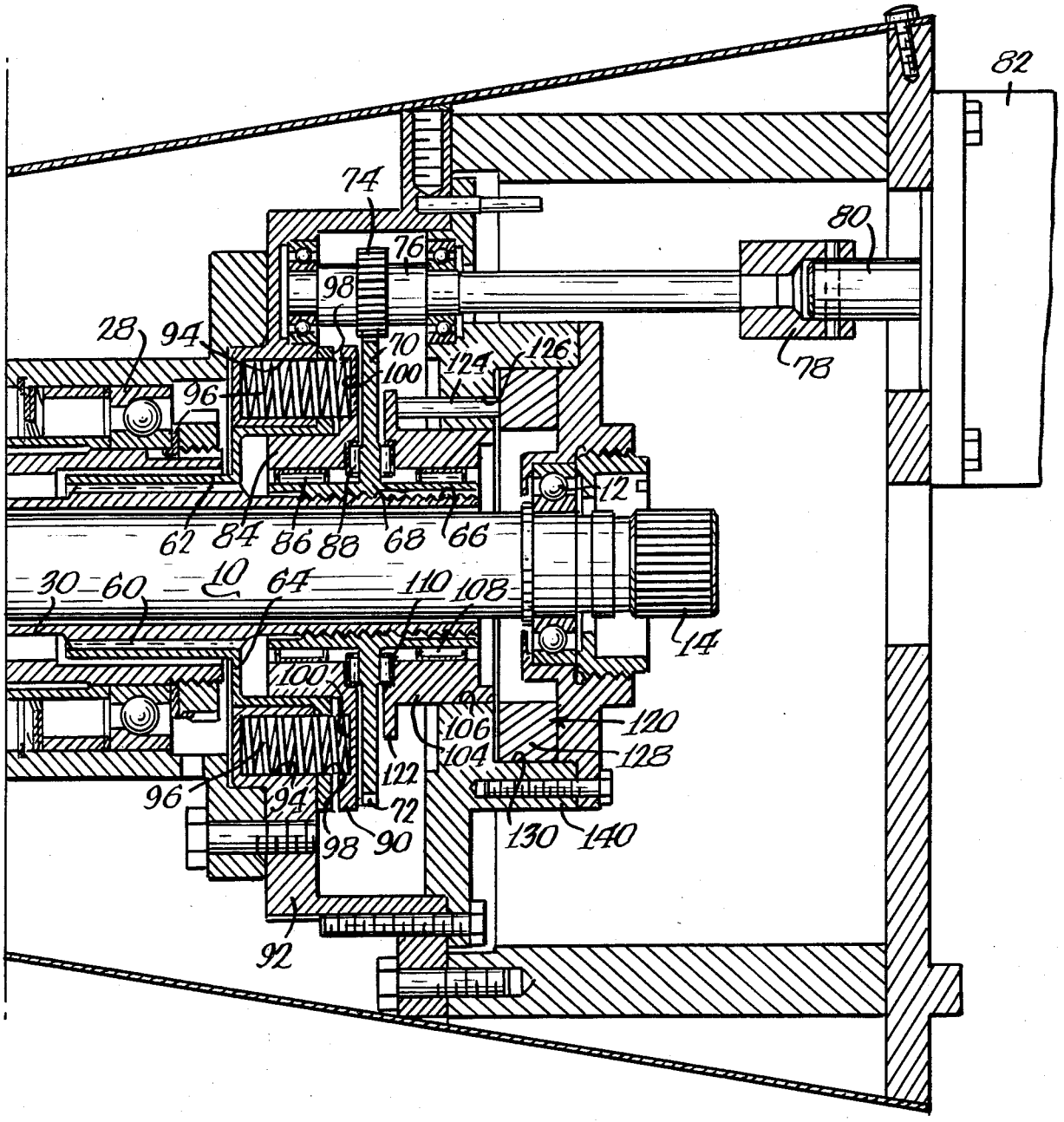

An exemplary embodiment of a blade pitch changing mechanism made according to the invention is illustrated in the drawings and with reference to FIGS. 1A and 1B, is seen to include an elongated, rotatable shaft 10. At one end, the shaft 10 is journalled in bearings 12 and includes a spline 14 for connection to a load (not shown).

At its opposite end, the shaft 10 includes splines 16 whereby the same mounts a hub 18. The hub 18 in turn mounts a plurality of turbine blades 20 (only one of which is shown). The blades 20 are journalled as by bearings 22 for rotation in the hub about an axis generally transverse to the axis of the shaft 10. The hub 18 mounts a rightwardly extending hollow shaft 24 which is journalled in bearings 26 and 28 and it will be appreciated that this structure effectively provides a journal for the end of the shaft 10 opposite the bearings 12.

Within the shaft 24, and about the shaft 10, is an elongated, hollow shaft 30. At its leftmost end, the shaft 30 mounts combination trust and journal bearings 32 within the hub 18.

The outer races of the bearings 32 are received in an annular groove 34 in a casing 36 forming part of a motion converting mechanism. The bearings 32 are clamped in such location by means of cap 38 held in place by a plurality of bolts 40 (only one of which is shown). As a consequence of this construction, it will be appreciated that the part 36 of the motion converting mechanism is rotatable relative to the shaft 30.

A leftward extension 42 of the part 36 extends about a sleeve 44 secured to the hub by the means shown with the consequence that the part 36 rotates with the hub 18.

Intermediate the extension 42 and the recess 34, the part 36 includes a slightly elongated groove 46 which is nominally aligned with the base 48 of a corresponding one of the blades 20 but slightly offset from the rotational axis for the blade 20 provided by the bearings 22. As shown in FIG. 1A, this axis of rotation lies along a screw 50.

The base 48 of each blade 20 mounts, at a location slightly displaced from the axis of rotation of the blade 20, a depending stub shaft 52 surrounded by a bearing 54 located in the groove 46.

The shaft 30 is a control shaft for the pitch of the blades 20 and is reciprocal along the length of the shaft 10. When moved to the left or the right, shoulders 56 and 58 on the shaft 30 and in abutment with the inner races of the bearings 32 correspondingly shift the bearings 32 axially to the left or to the right. This in turn shifts the part 36 of the motion connecting mechanism 36 to the left or the right and, as is conventional in mechanisms of this type, because of the disposition of the stub shaft 52 in the groove 46, coupled with the displacement of the stub shaft 52 from the rotational axis of the blades 20, such reciprocating motion of the shaft 30 will be converted to rotary motion to rotate the blades 20 within the bearings 22 and thereby change their pitch.

Intermediate its ends, the shaft 30 includes radially outwardly directed splines 60 received in an internal spline 62 of a base which is made nonrotatable with respect to the shaft 10 by any suitable means. The splines 60 and 62 are axial and thereby serve to guide the shaft 30 in a path of reciprocating movement as mentioned previously while preventing rotation of the same.

Between the splines 60 and the bearing 12, the shaft 30 is exteriorally threaded as at 66. An internally threaded nut 68 is threaded on the thread 66 and includes a radially outwardly directed, annular flange 70 terminating in peripheral gear teeth 72. It will accordingly be appreciated that if the axial position of the nut 68 is fixed, rotation of the same will drive the shaft 30 to the left or to the right, depending upon the direction of rotation of the nut 68.

Such rotation is accomplished by means of a spur gear 74 mounted on a shaft 76. The spur gear 74 is meshed with the teeth 72 and the shaft 76 is coupled by a coupling 78 to the output shaft 80 of a bi-directional stepping motor 82. Consequently, the stepping motor 82 may be operated to cause rotation of the nut 68 and thus reciprocation of the shaft 30 in an incremental fashion to provide for fine adjustment of the pitch of the blades 20.

To the left of the flange 70, and concentric about the shafts 10 and 30, is a collar 84. The collar 84 is nonrotatable as will be seen and consequently, journal bearings 86 are interposed between the collar 84 and the nut 68. The collar 84 is utilized to normally maintain the nut 68 in a desired axial position wherein its teeth 72 are meshed with the spur gear 74. Thus, thrust bearings 88 are interposed between the collar 84 and the flange 70.

The collar 84 has an outwardly directed flange 90 and fixed structure, that is, nonrotatable structure, in the form of a base 92 is provided with a plurality of spring chambers 94 in angularly spaced relation. Compression coil springs 96 are received within the spring chambers 94 and extend out of open ends 98 thereof to be received in alignment recesses 100 in the flange 90. Thus, the springs 96 provide a rightward bias, as viewed in FIG. 1B, to the collar 84 which in turn provides a rightward bias via the thrust washers 88 to the nut 68.

Rightward movement of the nut 68 in response to such bias is, however, limited by means of a collar 104 slidably received in a bore 106 of part of the base structure 92. The collar 104 is nonrotatable as will be seen and consequently, journal bearings 108 and thrust bearings 110 are interposed between the collar 104 and the nut 68 in a manner similar to the bearings 86 and 88.

A latching or escapement mechanism, generally designated 120 is operatively associated with the collar 104 to maintain the same in the axial position illustrated in FIG. 1B. Thus, by this means, the nut 68 will normally occupy the axial position illustrated to allow the stepping motor 82 to be effective to provide fine adjustment of the pitch of the blades 20. However, the mechanism 120 may be operated to release the collar 104 for movement to the right as viewed in FIG. 1B. Under this circumstance, the bias applied to the gear 68 by the springs 96 will move the gear 68 axially to the right as viewed in FIG. 1B. Such rightward movement of the gear 68 will carry the shaft 30 to the right with it and the arrangement is such that the shaft 30 will be moved sufficiently to the right to feather the blades 20.

Thus, the springs 96 act as a second motor for driving the shaft 30 rapidly to a predetermined position corresponding to a feathered position of the blades 20 in response to release of the nut 68 by the mechanism 120.

Figure 2:
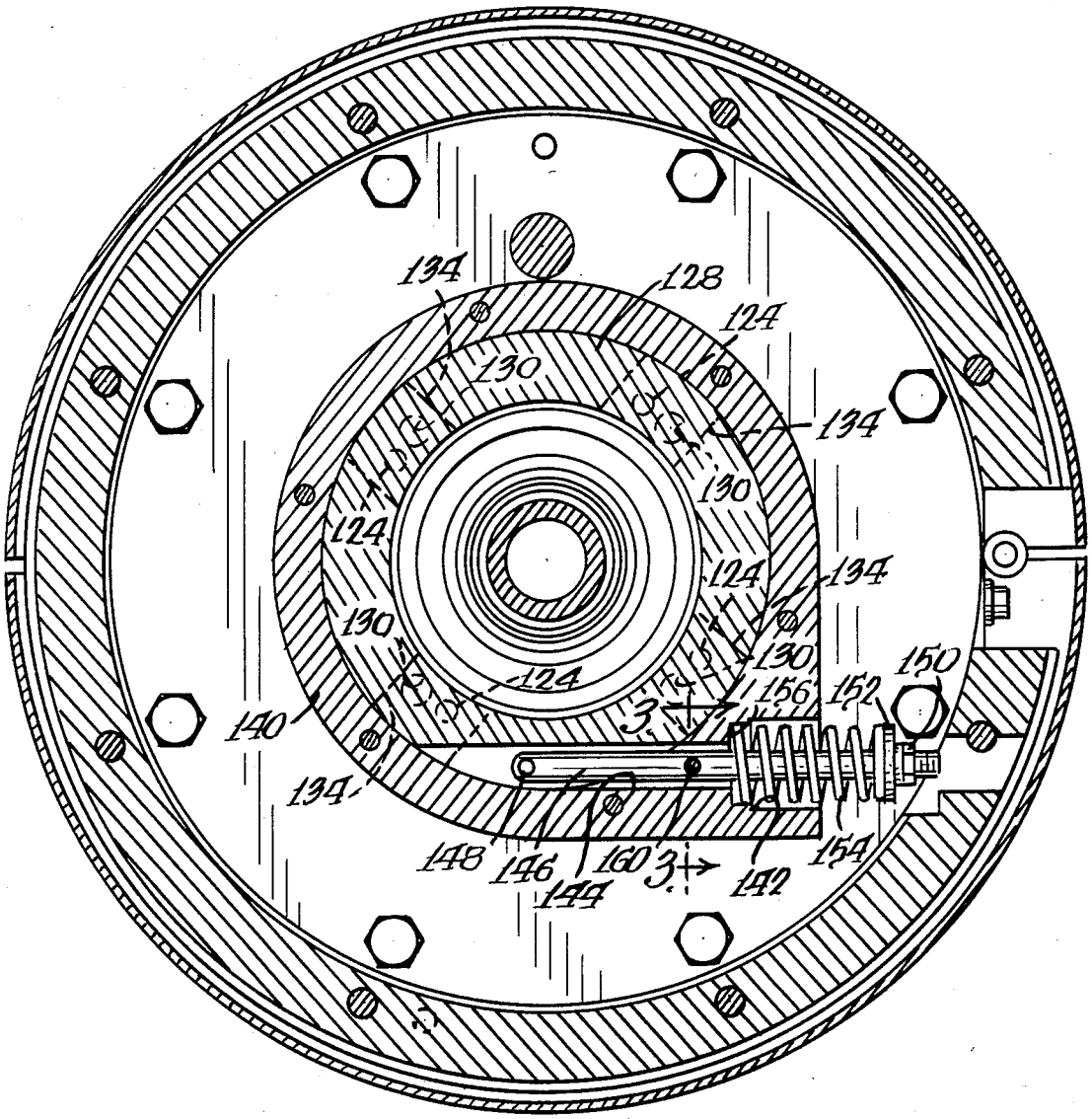
FIG. 2 is a sectional view of a portion of a latching or escapement mechanism employed in the invention.

The collar 104, on a radially outwardly directed flange 122 thereof, mounts a plurality of four axially directed fingers or pins 124. The pins 124 extend through corresponding bores 126 in part of the base structure and act as cam followers in engagement with a cam ring 128. The cam ring 128 is rotatable about the axis of the shaft 10, being concentric therewith and, as best seen in FIG. 2, includes a plurality of four axially directed recesses in the form of bores 130 which, upon rotation of the cam ring 128, are alignable with the pins 124. On the side of cam ring 128 facing the pins 124, as seen in FIG. 4, a ramp-like surface 134 is formed and in normal operation, the pins 124 abut the cam ring 128 on the ramps 134 under the influence of the springs 96.

However, when the cam ring 128 is rotated to bring the bores 130 into alignment with the pins 124, the latter will enter the former and the springs 96 will drive the nut 68 to the right as viewed in FIG. 1B to provide the feathering action for the blades 20 as mentioned previously.

Figure 4:
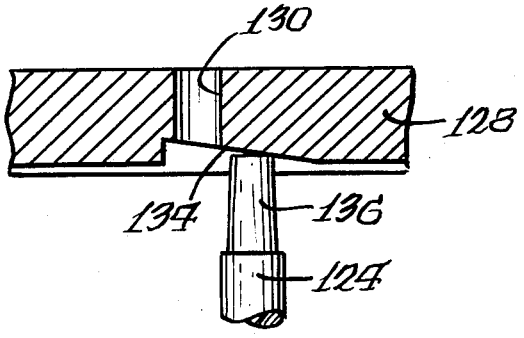
FIG. 4 is an enlarged, fragmentary view of a portion of the escapement mechanism.

To facilitate entry of the pins 124 into the bores 130, the pins 124 may be provided with reduced diameter, slightly tapered, frusto-conical ends 136 as seen in FIG. 4.

Figure 3:
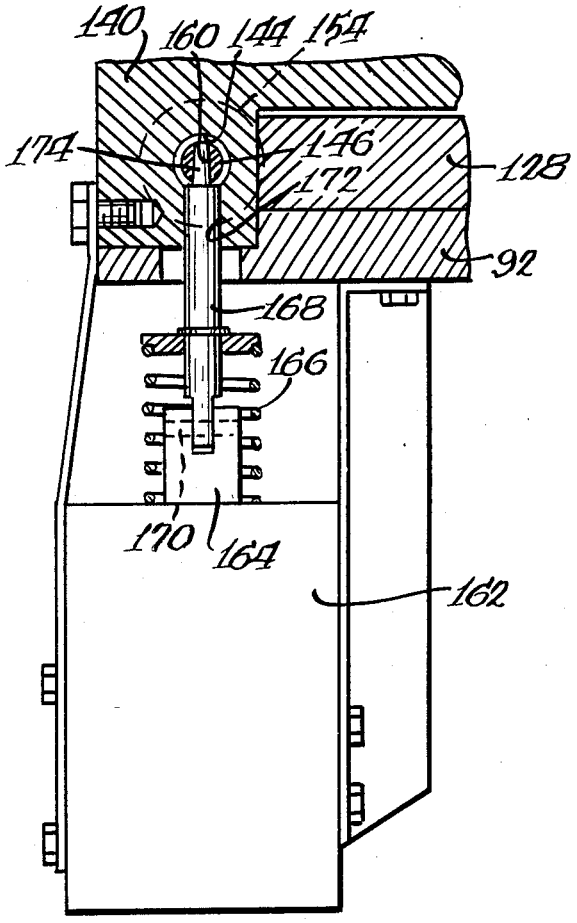
FIG. 3 is a fragmentary sectional view taken approximately along the line 3—3 in FIG. 2.

The cam ring 128 is rotatably received within the interior 138 of an annular flange 140 on part of the base structure 92. As seen in FIG. 3, at one location thereon, the annular flange 140 is provided with a large diameter recess 142 which merges with a small diameter bore 144. An actuating rod 146 is disposed within the bore 144 and extends out of the same and through the recess 142. The rod 146 is pivotably secured to the cam ring 128 by means of a pivot pin 148. Oppositely of the pin 148, a nut 150 and washer 152 capture and compress a coil spring 154 against a shoulder 156 at the point of union of the recess 142 and the bore 144. As can be seen from FIG. 3, this arrangement biases the cam ring 128 for rotary motion in the counterclockwise direction which will tend to align the bores 130 with the pins 124 after a few degrees of rotary movement of the cam 128. During such movement, because the ramps 134 become progressively deeper as the bores 130 are approached, it will be appreciated that there is little chance for the frictional engagement between the pins 124 and the cam ring 128 to seriously impede rotary movement of the cam ring 128 under bias of the spring 154.

Intermediate its ends, the rod 146 is provided with a bore 160 as seen in FIGS. 2 and 3. A portion of the base structure 92 mounts a solenoid coil 162 having an armature 164 retractable against the bias of a compression coil spring 166. A rod 168 is pivoted as at 170 to the armature 164 and extends upwardly through a bore 172 in the flange 140. The bore 172 is in alignment with and generally transverse to the bore 144. The upper end of the rod 168 includes a reduced diameter finger 174 which is sized to be receivable within the bore 160 in the rod 146.

In normal operation, the cam ring 128 will be in the position illustrated in FIGS. 1B and 2 that is, with the pins or fingers 144 nonaligned with the bores 130. At this time, the finger 174 will be located within the bore 160 thereby preventing the coil spring 154 from moving the rod 146 to the right as viewed in FIG. 2 which would cause counterclockwise rotation of the cam ring 128 and align the bores 130 with the fingers 144. At this time, pitch adjustment is made solely through the operation of the stepping motor 82 (FIG. 1B). Should however, it be desired to make a rapid pitch adjustment as by moving the blades 20 to a feathered position, the solenoid 162 is energized. This will draw the armature 164 into the coil 162 and pull the finger 174 out of the bore 160 in the rod 146. The spring 154 will then rotate the cam ring 128 to a position allowing the pins 124 to enter the bores 130. This will allow the collar 104 (FIG. 1B) to move rightwardly as viewed in FIG. 1B and such will occur under the influence of the springs 96. This in turn will drive the nut 68 to the right carrying the shaft 130 along its path of movement in the same direction and same movement will be converted by the motion converting mechanism to a feathering of the blades 20. It will also be observed that provision is made for sufficient rightward movement so as to enable the teeth 72 to become axially disengaged from the spur gear 74 so that further pitch adjustment by means of the stepping motor 82 cannot be had until the device is reset.

Any suitable conventional means may be employed for controlling the stepping motor 82 as well as the solenoid 162. In general, the latter will be operated only when the rotational speed of the shaft 10 begins to exceed some predetermined value and/or when an abrupt load change or loss of load is detected.

It will therefore be appreciated that a blade pitch changing mechanism made according to the invention is ideally suited for providing a rapid change of pitch in the event of emergency. While the mechanism has been described in connection with a ram air turbine, it will be appreciated that the principles of the invention may even be employed with efficacy in variable pitch propellers in aircraft or other like uses. The fine pitch adjustments desired in such mechanisms are readily provided by the stepping motor 82 and associated mechanical instrumentalities and yet, when necessary, rapid pitch changes may be effected through the use of the second motor including the springs 96.

I claim:

1. A blade pitch changing mechanism comprising:

a rotatable shaft;

a hub mounted on said shaft for rotation therewith;

at least one blade mounted on said hub for rotation about an axis intersecting said shaft;

a blade pitch control element extending generally parallel to said shaft and away from said hub, said control element being mounted for reciprocating movement in a path toward and away from said hub;

a reciprocating to rotary motion converting mechanism interconnecting said control element and said blade whereby the pitch of the blade may be controlled by controlling the reciprocal position of said control element in said path;

a first motor connected to said control element for incrementally reciprocally moving said control element within said path; and a second motor connected to said control element for grossly reciprocally moving said control element within said path.

2. A blade pitch changing mechanism comprising:

a rotatable shaft;

a hub mounted on said shaft for rotation therewith;

at least one blade mounted on said hub for rotation about an axis intersecting said shaft;

a blade pitch control element extending generally parallel to said shaft and away from said hub, said control element being mounted for reciprocating movement in a path toward and away from said hub;

a reciprocating to rotary motion converting mechanism interconnecting said control element and said blade whereby the pitch of the blade may be controlled by controlling the position of said control element in said path;

a first motor for incrementally moving said control element within said path; and a second motor for grossly moving said control element within said path, said control element being a hollow shaft concentric about said rotatable shaft; said hollow shaft being threaded at a location remote from said hub; and further including a rotatable nut threaded on said hollow shaft; said first motor rotating said nut in a fixed axial position, and said second motor moving said nut axially.

3. The blade pitch changing mechanism of claim 2 wherein said nut includes gear teeth and further including a gear meshed with said gear teeth, said first motor driving said gear, said second motor being operable to sufficiently move said nut axially as to disengage said gear teeth from said gear.

4. The blade pitch changing mechanism of claim 2 including an escapement mechanism normally locating said nut at a predetermined axial position, said second motor normally acting against said nut oppositely of said escapement mechanism; and means for operating said escapement mechanism to release said nut for axial movement by said second motor.

5. A turbine blade pitch changing mechanism comprising:

a rotatable shaft;

a hub mounted on said shaft for rotation therewith;

at least one turbine blade mounted on said hub for rotation about an axis intersecting said shaft;

a hollow, blade pitch control, reciprocating shaft extending generally concentrically about said rotatable shaft and away from said hub, said reciprocating shaft being mounted for reciprocating movement in a path toward and away from said hub;

a reciprocating to rotary motion converting mechanism interconnecting said reciprocating shaft and said blade whereby the pitch of the blade may be controlled by controlling the reciprocal position of said reciprocating shaft in said path along the length of said rotatable shaft;

a first motor connected to said reciprocating shaft for incrementally reciprocally moving said reciprocating shaft within said path; and a second motor connected to said reciprocating shaft for rapidly reciprocally moving said reciprocating shaft to a position within said path corresponding to a feathered position of said blade.

6. The turbine blade pitch changing mechanism of claim 5 wherein escapement means are provided for holding said reciprocating shaft in a predetermined axial position relative to said rotatable shaft, and said second motor comprises spring motor means biasing said reciprocating shaft toward said escapement means and said position, and means for operating said escapement means to release said reciprocating shaft.

7. The turbine blade pitch changing mechanism of claim 6 wherein said escapement means comprises a cam and a cam follower, one of said cam and said cam follower being in functional abutment with said reciprocating shaft; and means for moving the other of said cam and said cam follower relative to said one to release said reciprocating shaft.

8. A blade pitch changing mechanism comprising:

a rotatable shaft;

a hub mounted on said shaft for rotation therewith;

at least one blade mounted on said hub for rotation about an axis intersecting said shaft;

a blade pitch control element extending generally parallel to said shaft and away from said hub, said control element being mounted for reciprocating movement in a path toward and away from said hub;

a reciprocating to rotary motion converting mechanism interconnecting said control element and said blade whereby the pitch of the blade may be controlled by controlling the position of said control element in said path;

a motor connected to said control element for providing fine adjustment of the position of said control element within said path;

a spring connected to said control element for moving said control element toward a predetermined position within said path; and a latching mechanism associated with one of said spring and said control element and selectively operable to permit said spring to move said control element toward said predetermined position.

9. The blade pitch changing mechanism of claim 8 wherein said control element is threaded at a location remote from said hub and further including a rotatable nut threaded on said control element, said motor being operable to rotate said nut and said spring biasing said nut in an axial direction.

10. The blade pitch changing mechanism of claim 9 wherein said latching mechanism includes a cam follower having a plurality of axially directed fingers engaging said nut oppositely of said spring and a rotatable cam having a plurality of notches, each for receiving corresponding one of said fingers, a means for rotating said cam to allow said fingers to enter said notches.

11. The blade pitch changing mechanism of claim 10 wherein said control element is a hollow shaft concentrically receiving said rotatable shaft, and said cam and cam follower are concentric with said rotatable shaft.

* * * * *